US008696866B2

(12) United States Patent
Nasser

(10) Patent No.: US 8,696,866 B2
(45) Date of Patent: Apr. 15, 2014

(54) COATED PAPER AND A PROCESS FOR MAKING COATED PAPER

(75) Inventor: Nabil F. Nasser, Dayton, OH (US)

(73) Assignee: Miami Wabash llc, Norwalk, CT (US)

( * ) Notice: Subject to any disclaimer, the term of this patent is extended or adjusted under 35 U.S.C. 154(b) by 0 days.

(21) Appl. No.: 13/303,845

(22) Filed: Nov. 23, 2011

(65) Prior Publication Data

US 2012/0270032 A1 Oct. 25, 2012

Related U.S. Application Data

(60) Provisional application No. 61/458,504, filed on Nov. 23, 2010.

(51) Int. Cl.
*D21F 11/00* (2006.01)

(52) U.S. Cl.
USPC ..... 162/135; 162/164.5; 428/313.5

(58) Field of Classification Search
USPC ..... 162/135, 164.5; 428/313.3, 323, 407, 428/403; 427/150, 151; 503/200, 207
See application file for complete search history.

(56) References Cited

U.S. PATENT DOCUMENTS

| | | | | |
|---|---|---|---|---|
| 5,084,431 | A * | 1/1992 | Pilikos et al. | 503/200 |
| 5,342,649 | A * | 8/1994 | Sarokin | 427/150 |
| 5,902,453 | A * | 5/1999 | Ruch | 162/135 |
| 6,074,528 | A * | 6/2000 | Ruch | 162/135 |
| 6,077,392 | A * | 6/2000 | Ruch | 162/135 |
| 8,329,289 | B2 * | 12/2012 | Buri et al. | 428/323 |
| 2009/0162638 | A1 * | 6/2009 | Buri et al. | 428/323 |
| 2011/0237730 | A1 * | 9/2011 | Buri et al. | 524/425 |

* cited by examiner

*Primary Examiner* — Mark Halpern
(74) *Attorney, Agent, or Firm* — Ware, Fressola, Maguire & Barber LLP

(57) ABSTRACT

The present invention relates to a coated paper product and method for making the coated paper product. The product comprises a paper substrate, which can be of a low quality, that is coated with at least two layers of coating in one embodiment. A first coating layer is applied to the front and back sides of the paper substrate before a second coating layer is applied. The first coating layer comprises titanium dioxide, an aluminum silicate, calcium carbonate, clay and a binder. The second coating layer comprises hollow spherical particles, which provides the coating with an improved ability to spread while improving the coverage and formation of the coating layer, and also comprises a printing additive, titanium dioxide and a binder.

14 Claims, 3 Drawing Sheets

COATED PAPER AND A PROCESS FOR MAKING COATED PAPER

RELATED APPLICATIONS

This application claims the benefit of Provisional Application No. 61/458,504 filed on Nov. 23, 2010 entitled "Coated Paper and a Process for Making Coated Paper", which is hereby incorporated by reference in its entirety.

BACKGROUND OF THE INVENTION

In order to produce paper that is of a sufficient quality in terms of brightness, smoothness, opacity, reflectance and formation, the presently available solutions present several drawbacks. First, the paper substrate used cannot be of low quality. Although such substrates are less expensive, in order to covert the substrate into a viable end paper product, it requires an elaborate and costly process, which still produces a lower quality paper. Several layers of coating must be applied, which leaves the paper with an amount of coating that makes the paper undesirable, while requiring a sufficient amount of coating to negate the cost savings generated by using the low quality paper substrate. Second, if the paper substrate is of high quality, then although it would not require the level of coating as the low quality substrate, the cost of the paper substrate is such that it makes the final paper product more costly to produce and more expensive to consumers.

SUMMARY OF THE INVENTION

It is an object of the present invention to provide a coated paper that can be efficiently produced and utilize a low quality paper substrate, while also providing a coated paper that does not suffer any drawbacks in quality.

The present invention relates to a coated paper and a method for making the same. The coated paper uses a low quality paper substrate, such as 100% recycled board, brown natural kraft.

In a first embodiment of the invention, the paper substrate is coated with two layers of coating. A first layer comprises a mixture of titanium dioxide ($TiO_2$), an aluminum silicate, calcium carbonate ($CaCO_3$), clay, and a binder. The first layer may also comprise a co-binder or a dye. The first layer is coated on both the front and back sides of the paper substrate.

A second layer is applied to the coated paper substrate on top of the first layer on each side of the coated paper substrate. The second layer comprises hollow spherical particles, a printing additive, $TiO_2$, and a binder, and may also comprise a co-binder. The hollow spherical particles are further comprised of a nanoaluminum acrylic polymeric pigment latex foam illuminated with a white fluorescent agent. The hollow spherical particles further comprise a multicomponent of alkaline activated calcium bentonite. The hollow spherical particle has a 75% void volume with a size of less than 1 micron. The printing additive of the present invention can by poly[imino imido carbonyl imino imido carbonyl imino-hexyl methylene] hydrochloride.

It is also possible to add a third layer of coating on top of the second layer of coating, wherein the third layer of coating also comprises hollow spherical particles, a printing additive, $TiO_2$, and a binder, and may also comprise a co-binder. This third coating layer acts to even further enhance the gloss level and opacity of the coated paper.

By incorporating the hollow spherical particles in the coating, the coating has an improved ability to spread over the first coating, which results in using a decreased amount of total coating than is required for other coated papers, while also improving the coverage and formation of the coating layer.

A method for creating the coated paper comprises applying the first layer to the front and back sides of the paper substrate. The application of the first layer to the front and back sides of the paper substrate if preferably done simultaneously. After applying the first layer to the paper substrate, the second layer including hollow spherical particles is applied to the front and back sides of the paper. The application of the second layer to the front and back sides of the paper is preferably done simultaneously. The means of application of the layers is not limited to a particular application means. The method may further comprise applying a third coating layer including hollow spherical particles in a similar manner to the first and second coating layers. The method may further comprise calendering the coated paper after applying the second or third layers.

According to a second embodiment of the invention, a coated paper comprises one layer of coating. This coating layer comprises hollow spherical particles, a printing additive, $TiO_2$, and a binder and may also comprise a co-binder, as discussed above in reference to the second layer of the first embodiment.

A method for creating the coated paper according to the second embodiment of the invention comprises applying the coating layer to each side of the paper substrate. Each side of the paper substrate can be coated simultaneously in one pass. The means for applying the coating layer is not limited to a particular application means. The method may further comprise calendering the coated paper product, but it is not required that the coated paper be calendered.

A more efficiently produced paper is provided by the coated paper product of the present invention, while also providing a paper with improved coating formation and retention. With the coating layer or layers of the present invention, paper substrate of low quality, such as 100% recycled board, can be converted into a high quality finished paper while using significantly less coating. The present invention also provides a coated paper of high quality in terms of brightness, opacity and smoothness, and coat load, coating coverage and formation, without also requiring using either raw paper of high quality or low quality paper with several layers of thick coating, and without requiring coating primer. The present invention further provides for improved ink or pigment absorption when the coated paper is used with various writing instruments, such as pens, pencils and markers.

DETAILED DESCRIPTION OF THE DRAWINGS

Figure 1:
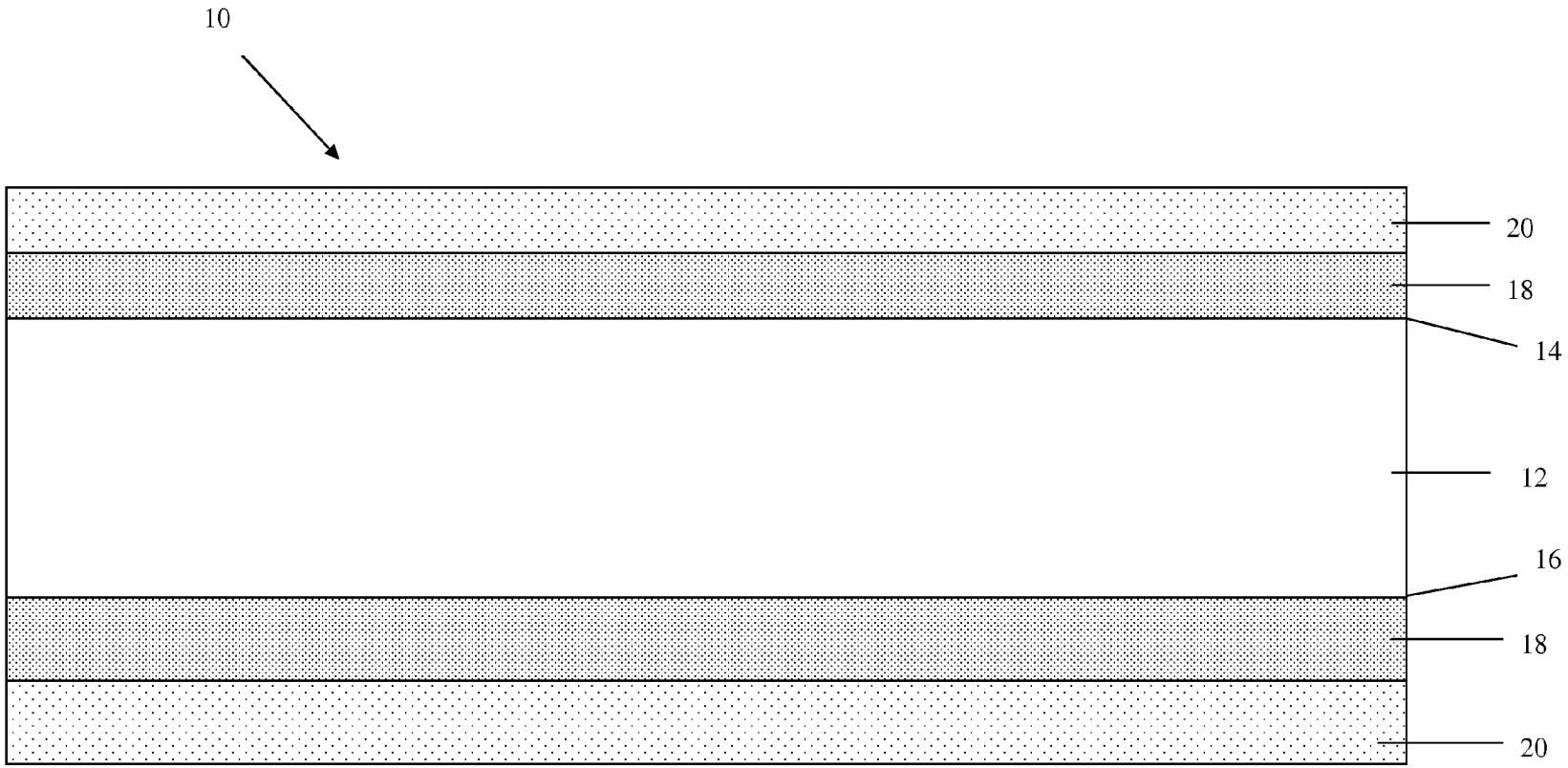
FIG. 1 shows a coated paper according to a first embodiment of the invention.
Figure 2:
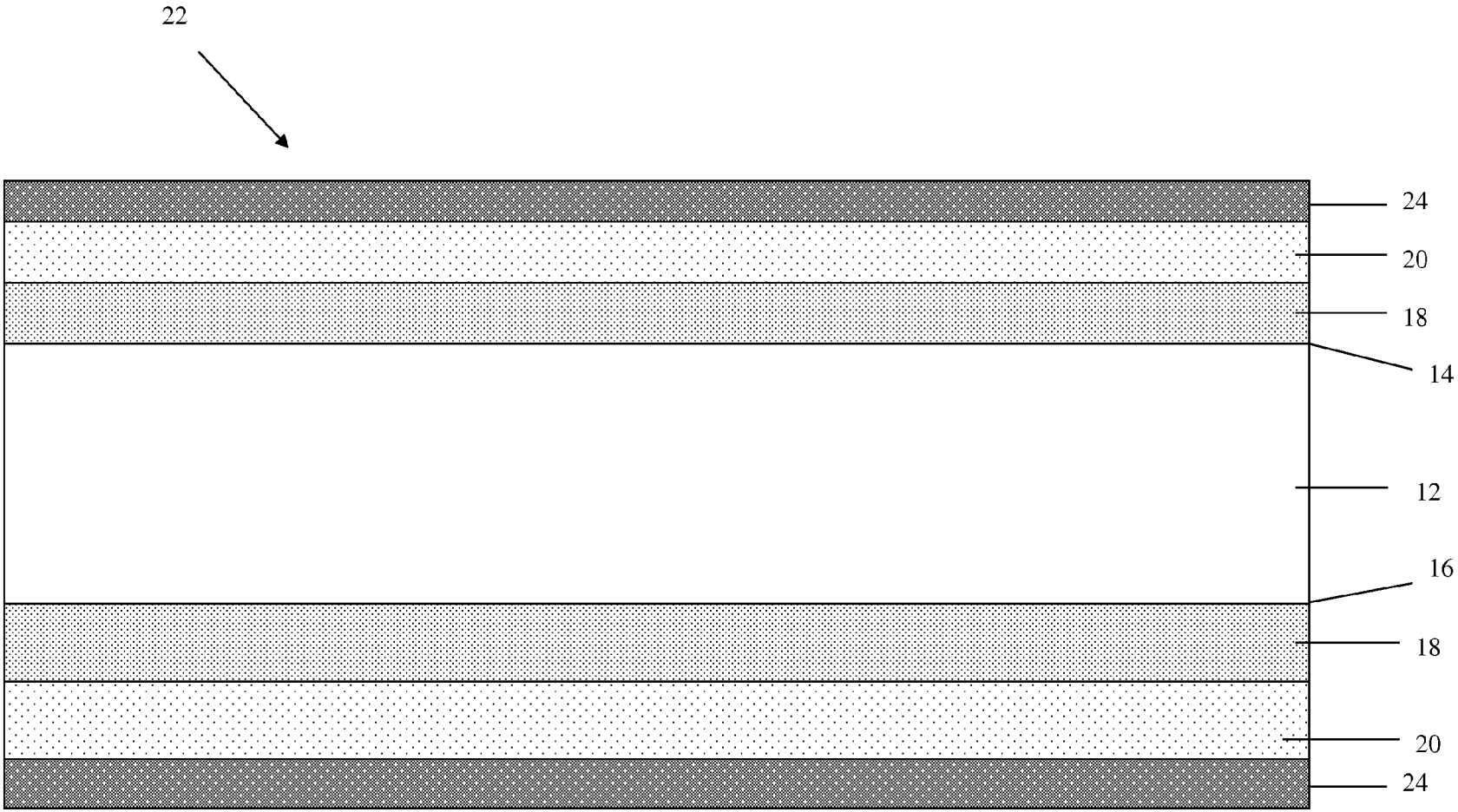
FIG. 2 shows an alternative coated paper according to a first embodiment of the invention.

With reference made to FIGS. 1 and 2, a paper that is multi-layered with coating, and a method for making the coated paper is described.

A coated paper product (10) which comprises a paper substrate (12), a first coating layer (18) on each side (14, 16) of the paper substrate, and a second coating layer (20) atop each first coating layer (18).

The paper substrate (12) of the coated paper (10) is a recycled material. Specifically, the material in a preferred embodiment is 100% recycled board, brown natural kraft.

The first coating layer (18) comprises $TiO_2$, an aluminum silicate, $CaCO_3$, clay, and binder. In a preferred embodiment, the binder is SBR latex, however, the binder that can be used in the first coating layer (18) can be one of many other binders, including acrylic, ethylene vinyl acetate (EVA), or polyurethane. The binder can constitute between 5% and 40% of the total dry weight of the coating layer, but it is preferred that the binder constitutes between 6% and 15%. The binder preferably has a glass transition temperature ($T_g$) greater than 20° C. Pigment with a $T_g$ greater than 50° C. may be added to the binder. The first coating layer may also comprise a co-binder, which can constitute up to 10% of the total dry weight of the first coating layer (18), but preferably comprises between 2% and 6% of the total dry weight of the first coating layer (18). The co-binder of the first coating layer (18) is also not limited to a particular co-binder, but may be a co-binder such as starch, protein or polyvinyl alcohol (PVA). The first coating layer (18) may also comprise a dye.

It is preferred that between 9 grams and 20 grams of the first coating (18) are applied to the paper substrate (12), however, the amount of the first coating that can be applied to the paper substrate (12) can range from 5 grams to 30 grams. The first coating layer (18) is applied to the paper substrate (12) in order to improve the opacity, brightness and smoothness of the paper substrate (12).

The first coating layer (18) can be applied using any of a number coating techniques, including: air knife coating, Meyer rod coating, gravure coating, reverse gravure coating, reverse roll coating, slot dye coating, or curtain roll coating. The coating (18) is in applied in a coating solvent that is between 25% and 70% solid, and preferably between 35% and 60% solid. The coating solvent has a viscosity of 700 cP or less and a pH of 8 or greater.

The second coating layer (20) is applied to the first coating layer (18) on each side (14, 16) of the paper substrate (12). The second coating layer (20) comprises hollow spherical particles, a printing additive, $TiO_2$, and a binder, and may also comprise a co-binder. The amount of the second coating layer (20) that is applied can range from 15 grams to 85 grams, but it is preferred that between 25 grams and 55 grams be used.

The hollow spherical particles of the second coating layer (20) comprise a multicomponent of alkaline activated, calcium bentonite. The bentonite improves retention of the coating layer (20) and improves the coating formation without mottling. The hollow sphere particle shell comprises a nanoaluminum acrylic polymeric pigment latex foam. The size of the spherical particle is less than 1 micron and the particle has 75% void volume. The spherical particles are further illuminated with a white fluorescent agent. The white fluorescent agent increases the brightness of the coating (20), and therefore the brightness coated paper product (10). The hollow spherical particles can constitute between 5% and 50% of the total dry weight of the second coating layer (20), but preferably constitute between 9% and 30%.

The use of the hollow spherical particles results in an improved spreading of the layer of coating (20) on the paper substrate, such that significantly less coating (20) can be used than would be expected. The hollow spherical particles also prevent smearing of the coating (20), and improves overall coverage and formation of the coating layer (20).

The preferred printing additive of the second coating layer (20) is poly[imino imido carbonyl imino imido carbonyl imino-hexyl methylene] hydrochloride. The printing additive constitutes between 2% and 3% of the dry weight of the coating layer (20). The printing additive improves the print quality of the coated paper (10).

The binder of the second coating layer (20) is not limited to a particular binder, but may be SBR latex, acrylic, EVA, or polyurethane. The binder can constitute between 5% and 40% of the total dry weight of second coating layer (20), and preferably constitutes between 6% and 15%. The co-binder of the second coating layer (20) is also not limited to a particular co-binder, but may be a co-binder such as starch, protein or PVA. The co-binder can constitute between 0% and 10% of the total dry weight of second coating layer (20), and preferably constitutes between 2% and 6%.

The second coating layer (20) can be applied to the coated paper substrate using any of a number coating techniques, including: air knife coating, Meyer rod coating, gravure coating, reverse gravure coating, reverse roll coating, slot dye coating, or curtain coating. If curtain coating is used, it is also possible to apply both the first and second coating layers (18, 20), by applying the second coating layer (20) on the still wet first coating layer (18). The coating (20) is in applied in a coating solvent that is between 25 and 70% solid, and preferably between 35 and 60% solid. The coating solvent has a viscosity of 700 cP or less and a pH of 8 or greater.

After the second coating layer (20) is applied, the coated paper (10) may be calendered to further enhance the reflectance of the coated paper (10) and to reduce the thickness of the coated paper (10). The reflectance of the coated paper (10) is between 5 and 40 on angle of 75° when the coated paper (10) is not calendered. If calendered, the reflectance is between 20 and 65 on an angle of 75°. The coated paper (10) is calendered at between 1000 p.l.i. and 3000 p.l.i., with it preferred that calendering apply 2000 p.l.i. If calendered, the thickness of the coated paper (10) is reduced to between 2 and 3 mils (with 1 mil being equivalent to 25.4 microns).

The gloss level and opacity of coated paper (10) can be further increased by adding a third coating layer (24) to create coated paper (22). If the third coating layer (24) is applied, between 5 grams and 20 grams can be applied, but it is preferred that 8 g to 10 g is applied. The third coating layer (24) comprises the same elements as second coating layer (20), however, in the third coating layer (24), the spherical particles preferably constitute between 8% and 35% of the total dry weight of the coating (24), but can also constitute between 5% and 60% of the total dry weight of the coating layer (24).

It is also possible to incorporate a fluorescent optical primer into the two-layered coated paper (10) and three-layered coated paper (22). In the two-layered coated paper (10), the fluorescent optical primer is included in the first coating layer (18). In the three-layered coated paper (22), the fluorescent optical primer is included in the second coating layer (20). The fluorescent optical primer is not included in the top-most layer in either embodiment in order to protect the coated papers (10, 22) from damage caused by ultraviolet light. When it is included in either the first coating layer (18) or second coating layer (22) as described above, the fluorescent optical primer can constitute as much as 3% of the total wet weight of the respective coating layers, but it is preferred that the fluorescent optical primer constitute between 1% and 2% of the total wet weight.

Figure 3:
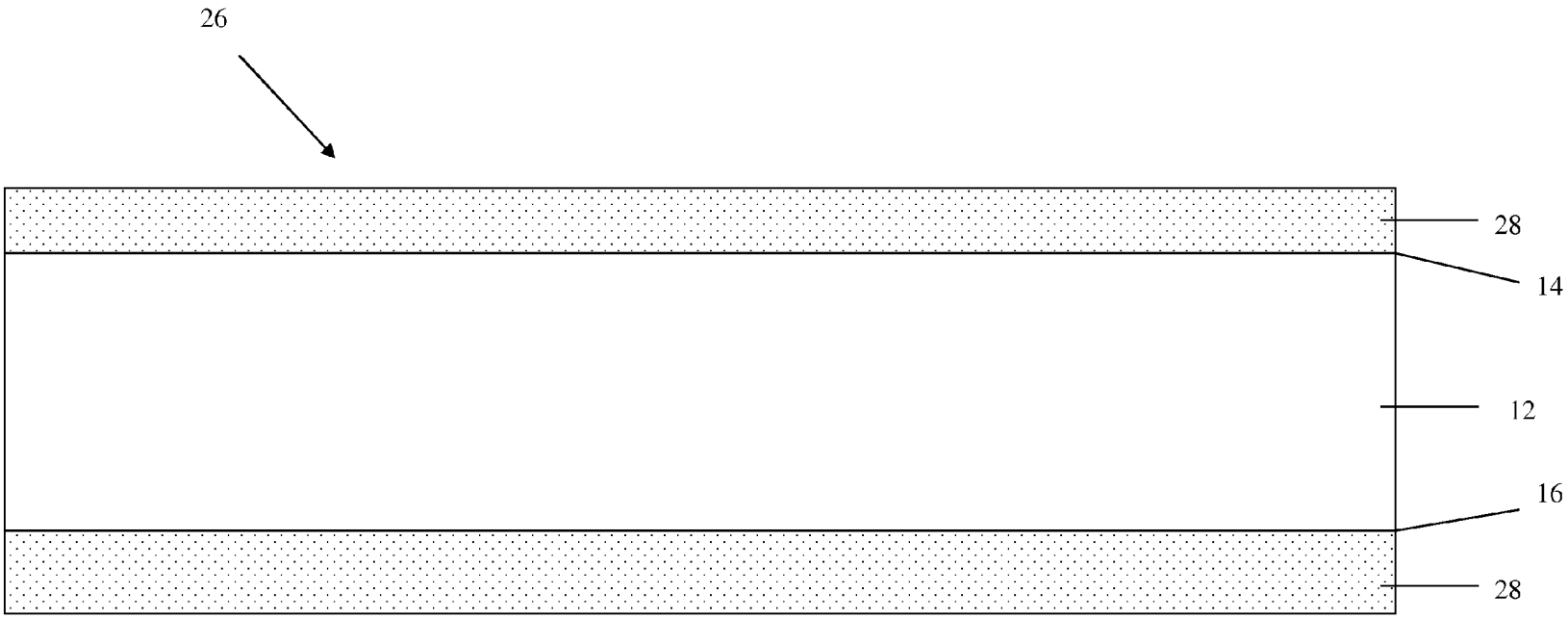
FIG. 3 shows a coated paper according to a second embodiment of the invention.

With reference made to FIG. 3, a paper that is coated with a single layer of coating, and a method for making the coated paper is described.

According to a second embodiment of the invention, a coated paper (26) comprises one layer (28) of coating. This coating layer (28) is similar to the second coating layer (20) described above, and comprises hollow spherical particles, a printing additive, $TiO_2$, and a binder, and may also comprise a co-binder, as discussed above in reference to the second coating layer (20). The hollow spherical particles constitute between 5% and 50% of the dry weight of the coating layer, with a preferred amount being between 9% and 30%. Between 15 grams and 85 grams of the coating layer (28) can be applied to the paper substrate (12), but it is preferred that between 25 grams and 55 grams be applied. The coating layer (28) is applied to each side (14, 16) of the paper substrate, and the technique of application is not limited to a single technique, but includes: air knife coating, Meyer rod coating, gravure coating, reverse gravure coating, reverse roll coating, slot dye coating, or curtain roll coating.

Accordingly, coated papers have been described which achieve the objects of the invention herein. It will be appreciated that the papers described are preferred embodiments illustrating the various objects and features of the invention, and that changes may be made by those skilled in the art without departing from the spirit and scope of the invention which is limited only by the following claims.

What is claimed:

1. A coated paper product comprising:

a paper substrate comprising a front and a back side;

a first layer of coating applied to the front and back sides of the paper substrate; and a second layer of coating applied over the first layer of coating on the front and back sides of the paper substrate;

wherein the second layer of coating comprises hollow, spherical particles comprising a nano aluminium polymeric pigment latex foam having a size of about one micron or less and with a void volume of about 75%, and a multicomponent of calcium bentonite.

2. A coated paper product comprising:

a paper substrate comprising a front and a back side; and a first layer of coating applied to the front and back sides of the paper substrate; and wherein the first layer of coating comprises hollow, spherical particles comprising a nanoaluminum polymeric pigment latex foam having a size of about one micron or less and with a void volume of about 75%, and a multicomponent of calcium bentonite.

3. A coated product comprising:

a substrate comprising one or both recycled board and brown natural kraft and having a front side and a back side;

a first layer of coating applied to one of the front and back sides of the paper substrate; and a second layer of coating applied over the first layer of coating;

wherein the second layer of coating comprises hollow, spherical particles comprising a nanoaluminium polymeric pigment latex foam having a size of about one micron or less and with a void volume of about 75%, and a multicomponent of calcium bentonite.

4. The coated product according to claim 3, wherein the first layer of coating comprises a mixture of titanium dioxide, an aluminum silicate, calcium carbonate, clay, and a binder.

5. The coated product according to claim 4, wherein the first layer of coating comprises a co-binder, a dye or both.

6. The coated product according to claim 4, the binder constitutes between 6% and 15% of the total dry weight of the first coating layer and has a glass transition temperature greater than 20° C.

7. The coated product according to claim 3, wherein the second layer of coating further comprises a printing additive, titanium dioxide, and a binder.

8. The coated product according to claim 7, wherein the printing additive is polyimino imido carbonyl imino imido carbonyl imino-hexyl methylene hydrochloride.

9. The coated product according to claim 7, wherein the printing additive constitutes between 2% and 3% of the total dry weight of the second coating layer.

10. The coated product according to claim 7, wherein the binder constitutes between 6% and 15% of the total dry weight of the second coating layer.

11. The coated product according to claim 3, wherein the hollow spherical particles further comprise a white fluorescent agent.

12. The coated product according to claim 11, wherein the multicomponent of calcium bentonite is alkaline activated calcium bentonite.

13. The coated product according to claim 3, further comprising a third layer of coating applied over the second layer of coating and applied on the front and back sides of the paper substrate, wherein the third layer of coating comprises hollow, spherical particles comprising a nanoaluminum polymeric pigment latex foam having a size of about one micron or less and with a void volume of about 75%, and a multicomponent of calcium bentonite.

14. The coated product according to claim 3, wherein the hollow spherical particles constitute between 9% and 30% of the total dry weight of the second coating layer.

* * * * *